US009620346B2

(12) United States Patent
Giles

(10) Patent No.: US 9,620,346 B2
(45) Date of Patent: Apr. 11, 2017

(54) MASS SPECTROMETER

(75) Inventor: Kevin Giles, Cheshire (GB)

(73) Assignee: Micromass UK Limited, Wilmslow (GB)

( * ) Notice: Subject to any disclaimer, the term of this patent is extended or adjusted under 35 U.S.C. 154(b) by 3105 days.

(21) Appl. No.: 11/721,729

(22) PCT Filed: Dec. 16, 2005

(86) PCT No.: PCT/GB2005/004902
§ 371 (c)(1),
(2), (4) Date: Jul. 2, 2009

(87) PCT Pub. No.: WO2006/064274
PCT Pub. Date: Jun. 22, 2006

(65) Prior Publication Data

US 2009/0272891 A1 Nov. 5, 2009

Related U.S. Application Data

(60) Provisional application No. 60/642,207, filed on Jan. 7, 2005.

(30) Foreign Application Priority Data

Dec. 17, 2004 (GB) ..... 0427634.1

(51) Int. Cl.
*H01J 49/26* (2006.01)
*H01J 49/06* (2006.01)

(52) U.S. Cl.
CPC ..... *H01J 49/062* (2013.01); *Y10T 29/49165* (2015.01)

(58) Field of Classification Search
USPC ... 250/396 R, 397, 398, 281, 282, 283, 294, 250/296
See application file for complete search history.

(56) References Cited

U.S. PATENT DOCUMENTS

| | | | |
|---|---|---|---|
| 4,556,823 | A | 12/1985 | Keller et al. |
| 4,985,626 | A | 1/1991 | Margulies |
| 5,572,035 | A | 11/1996 | Franzen |

(Continued)

FOREIGN PATENT DOCUMENTS

| | | |
|---|---|---|
| GB | 2395355 | 5/2004 |
| GB | 2412493 | 9/2005 |

(Continued)

*Primary Examiner* — Nicole Ippolito
(74) *Attorney, Agent, or Firm* — Diederiks & Whitelaw, PLC

(57) ABSTRACT

A mass spectrometer is disclosed comprising an ion guide. The ion guide comprises a hollow tubular conductor having a wall. One or more electrodes are provided in the wall of the tubular conductor. An exit aperture is provided in the wall of the tubular conductor downstream of the one or more electrodes. An AC or RF voltage is applied to the one or more electrodes and a DC potential difference is maintained between the wall of the tubular conductor and the one or more electrodes. The combination of a DC voltage gradient and applying an AC or RF voltage to the electrodes is that ions are confined radially to a region which is preferably close to the one or more electrodes. Ions are preferably extracted from the ion guide via the exit aperture.

25 Claims, 6 Drawing Sheets

(56) References Cited

U.S. PATENT DOCUMENTS

| | | | | |
|---|---|---|---|---|
| 5,847,386 | A | 12/1998 | Thomson et al. | |
| 5,869,831 | A | 2/1999 | De La Mora et al. | |
| 6,674,071 | B2 | 1/2004 | Franzen et al. | |
| 6,690,004 | B2 | 2/2004 | Miller et al. | |
| 6,700,119 | B1 | 3/2004 | Giles | |
| 6,707,032 | B2 | 3/2004 | Speakman et al. | |
| 6,759,651 | B1 | 7/2004 | Li | |
| 6,825,474 | B2 | 11/2004 | Young | |
| 2003/0146377 | A1 | 8/2003 | Miller et al. | |
| 2003/0178564 | A1* | 9/2003 | Kernan | H01J 49/063 250/292 |
| 2005/0116162 | A1* | 6/2005 | Vestal | H01J 49/004 250/287 |
| 2005/0258364 | A1* | 11/2005 | Whitehouse et al. | 250/292 |

FOREIGN PATENT DOCUMENTS

| | | |
|---|---|---|
| JP | 2000-123781 | 4/2000 |
| JP | 2002-15699 | 1/2002 |
| JP | 2004-14177 | 1/2004 |

* cited by examiner

MASS SPECTROMETER

CROSS REFERENCE TO RELATED APPLICATIONS

This application is the National Stage of International Application No. PCT/GB2005/004902, filed on Dec. 16, 2005, which claims priority to and benefit of U.S. Provisional Patent Application Ser. No. 60/642,207, filed on Jan. 7, 2005, and priority to and benefit of United Kingdom Patent Application No. 0427634, filed Dec. 17, 2004. The entire contents of these applications are incorporated herein by reference.

BACKGROUND OF THE INVENTION

The present invention relates to an ion guide, a mass spectrometer, a method of guiding ions and a method of mass spectrometry. The preferred embodiment relates to an ion guide or ion transport device which preferably uses a combination of a DC voltage and an AC or RF voltage in order to focus and/or transport ions through the ion guide or ion transport device preferably in the presence of background gas.

A known multipole rod set ion guide comprises four, six or eight parallel rods which are equi-spaced about a circular circumference. Opposite phases of a two-phase RF voltage are applied to adjacent rods. The RF voltage applied to the rods generates a symmetrical pseudo-potential well within the ion guide which acts to confine ions radially within the ion guide. If the ion guide is operated at a relatively high pressure then the ion radial density distribution may also be reduced due to the effect of collisional cooling wherein ions lose kinetic energy after colliding with gas molecules.

Another known ion guide comprises a plurality of ring electrodes having apertures through which ions are transmitted. Opposite phases of a two-phase RF voltage are applied to adjacent ring electrodes. The ion guide may comprise an ion tunnel ion guide comprising ring electrodes which all have substantially the same diameter apertures. Alternatively, the ion guide may comprise an ion funnel ion guide comprising ring electrodes having apertures which progressively reduce in diameter along the axial length of the ion guide.

Another known ion guide comprises a stack or array of layers of intermediate electrodes which are arranged horizontally in the plane of ion motion. Each intermediate layer comprises two longitudinal electrodes which are spaced apart from one another with an ion guiding region provided in between. Opposite phases of an RF voltage are applied to vertically adjacent or neighbouring layers of intermediate electrodes. The two longitudinal electrodes in any of the layers of intermediate electrodes are connected to the same phase of the RF voltage. The ion guide also further comprises an upper planar electrode and a lower planar electrode which act to confine ions in the vertical radial direction. A DC and/or AC or RF voltage may be applied to the upper and lower planar electrodes in order to confine ions within the ion guide.

The known multipole rod set ion guide provides ion confinement in the radial direction when used to transmit a relatively narrow beam of ions. However, it is problematic to increase the size of the ion guide in the radial dimension in order to capture ions from a more diffuse source since this requires increasing the RF voltage applied to the rods in proportion to the square of the radius. Furthermore, even with the same confining effective potential barrier the degree of focussing would be reduced in a larger ion guide due to the reduced radial effective potential gradient.

It may also be problematic to attempt to use an ion tunnel ion guide in conjunction with a diffuse ion source.

Although an ion funnel ion guide may be used to focus ions from a diffuse source, there is a direct line of sight between the ion entrance aperture and the ion exit aperture. The same is also true of an ion guide comprising a stock or array of planar electrodes arranged in the plane of ion motion. Such ion guides can suffer from the problem of gas streaming which increases the pumping requirements. Furthermore, if a mixture of gas and ions is arranged to enter the ion guide and the mixture also contains neutral species or droplets then these can pass through the ion guide and contaminate the various apertures.

It is therefore desired to provide an improved ion guide.

SUMMARY OF THE INVENTION

According to an aspect of the present invention there is provided an ion guide comprising:

a hollow, tubular or mesh device having a wall; and one or more electrodes arranged in, along, on or substantially adjacent to a portion of the wall.

The hollow, tubular or mesh device preferably has a substantially circular cross-section or cross-sectional profile. However, according to other embodiments the hollow, tubular or mesh device may have a substantially oval, rectangular, square, polygonal, curved, regular or non-regular cross-section or cross-sectional profile.

The hollow, tubular or mesh device preferably has an internal diameter or dimension selected from the group consisting of: (i) ≤1.0 mm; (ii) ≤2.0 mm; (iii) ≤3.0 mm; (iv) ≤4.0 mm; (v) ≤5.0 mm; (vi) ≤6.0 mm; (vii) ≤7.0 mm; (viii) ≤8.0 mm; (ix) ≤9.0 mm; (x) ≤10.0 mm; and (xi) >10.0 mm.

According to an embodiment the hollow, tubular or mesh device preferably has a central axis disposed in or along the centre or middle of the hollow, tubular or mesh device and wherein the one or more electrodes are preferably arranged or disposed offset from or to one side of the central axis.

The one or more electrodes are preferably arranged along one or more axes which are preferably substantially parallel to the central axis. According to a less preferred embodiment the one or more electrodes may be arranged along one or more axes which make an angle with and which intersect the central axis.

Some or all of the one or more electrodes preferably have an axial length and/or width and/or height selected from the group consisting of: (i) <1 mm; (ii) 1-5 mm; (iii) 5-10 mm; (iv) 10-15 mm; (v) 15-20 mm; (vi) 20-25 mm; (vii) 25-30 mm; (viii) 30-35 mm; (ix) 35-40 mm; (x) 40-45 mm; (xi) 45-50 mm; and (xii) >50 mm.

Some or all of the one or more electrodes preferably have a cross-sectional diameter or dimension selected from the group consisting of: (i) <0.01 mm; (ii) 0.01-0.05; (iii) 0.05-0.1 mm; (iv) 0.1-0.2 mm; (v) 0.2-0.3 mm; (vi) 0.3-0.4 mm; (vi) 0.4-0.5 mm; (vii) 0.5-0.6 mm; (viii) 0.6-0.7 mm; (ix) 0.7-0.8 mm; (x) 0.8-0.9 mm; (xi) 0.9-1 mm; (xii) 1-2 mm; (xiii) 2-3 mm; (xiv) 3-4 mm; (xv) 4-5 mm; (xvi) 5-10 mm; (xvii) 10-15 mm; (xviii) 15-20 mm; (xix) 20-25 mm; (xx) 25-30 mm; (xxi) 30-35 mm; (xxii) 35-40 mm; (xxiii) 40-45 mm; (xxiv) 45-50 mm; and (xxv) >50 mm.

Some or all of the one or more electrodes may preferably be spaced x mm centre-to-centre from each other, wherein x is selected from the group consisting of: (i) <0.01 mm; (ii) 0.01-0.05; (iii) 0.05-0.1 mm; (iv) 0.1-0.2 mm; (v) 0.2-0.3 mm; (vi) 0.3-0.4 mm; (vi) 0.4-0.5 mm; (vii) 0.5-0.6 mm;

(viii) 0.6-0.7 mm; (ix) 0.7-0.8 mm; (x) 0.8-0.9 mm; (xi) 0.9-1 mm; (xii) 1-2 mm; (xiii) 2-3 mm; (xiv) 3-4 mm; (xv) 4-5 mm; (xvi) 5-10 mm; (xvii) 10-15 mm; (xviii) 15-20 mm; (xix) 20-25 mm; (xx) 25-30 mm; (xxi) 30-35 mm; (xxii) 35-40 mm; (xxiii) 40-45 mm; (xxiv) 45-50 mm; and (xxv) >50 mm.

The one or more electrodes preferably have a substantially circular, oval, rectangular, square, polygonal, curved, regular or non-regular cross-section or cross-sectional profile.

The one or more electrodes preferably comprise one or more rod, wire, mesh, tubular, ring, planar or cubic shaped electrodes.

According to an embodiment the ion guide preferably comprises AC or RF voltage means arranged and adapted to apply an AC or RF voltage to at least some or all of the one or more electrodes.

The AC or RF voltage means is preferably arranged and adapted to apply an AC or RF voltage to at least 5%, 10%, 15%, 20%, 25%, 30%, 35%, 40%, 45%, 50%, 55%, 60%, 65%, 70%, 75%, 80%, 85%, 90%, 95% or 100% of the one or more electrodes.

The AC or RF voltage means is preferably arranged and adapted to apply an AC or RF voltage to at least 5%, 10%, 20%, 30%, 40%, 50%, 60%, 70%, 80%, 90%, 95% or 100% of the one or more electrodes in order to repel or substantially prevent at least some ions from striking, colliding with or approaching the one or more electrodes.

According to an embodiment the AC or RF voltage means is preferably arranged and adapted to supply an AC or RF voltage to the one or more electrodes having an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak.

The AC or RF voltage means is preferably arranged and adapted to supply an AC or RF voltage to the one or more electrodes having a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

Immediately adjacent electrodes of the one or more electrodes are preferably supplied with opposite phases of the AC or RF voltage.

According to an embodiment the ion guide further comprises two sets of interleaved electrodes. A first set of electrodes is connected to a first phase of the AC or RF voltage. A second set of electrodes is connected to a second different phase of the AC or RF voltage.

According to an embodiment the ion guide preferably further comprises means arranged and adapted to maintain a DC potential difference between at least a portion of the wall of the hollow, tubular or mesh device and some or all of the one or more electrodes.

According to an embodiment the DC potential difference is preferably selected from the group consisting of: (i) <1 V; (ii) 1-5 V; (iii) 5-10 V; (iv) 10-15 V; (v) 15-20 V; (vi) 20-25 V; (vii) 25-30 V; (viii) 30-35 V; (ix) 35-40 V; (x) 40-45 V; (xi) 45-50 V; and (xii) >50 V.

The one or more electrodes preferably comprise 1, 2, 3, 4, 5, 6, 7, 8, 9, 10, 11, 12, 13, 14, 15, 16, 17, 18, 19, 20 or >20 electrodes.

At least 1, 2, 3, 4, 5, 6, 7, 8, 9, 10, 11, 12, 13, 14, 15, 16, 17, 18, 19, 20 or >20 of the one or more electrodes may be arranged to loop around or at least partially loop around one or more apertures provided in the hollow, tubular or mesh device.

At least 1, 2, 3, 4, 5, 6, 7, 8, 9, 10, 11, 12, 13, 14, 15, 16, 17, 18, 19, 20 or >20 of the electrodes may be arranged so as to terminate at or upstream of one or more apertures provided in the hollow, tubular or mesh device.

The one or more electrodes may be axially segmented and comprise a plurality of electrodes arranged along the axial length of the ion guide.

According to an embodiment the ion guide may further comprise means for applying one or more transient DC voltages or potentials or one or more transient DC voltage or potential waveforms to some or all of the one or more electrodes in order to urge at least some ions along at least 5%, 10%, 15%, 20%, 25%, 30%, 35%, 40%, 45%, 50%, 55%, 60%, 65%, 70%, 75%, 80%, 85%, 90%, 95% or 100% of the axial length of the ion guide.

According to an embodiment the ion guide may comprise means for applying two or more phase-shifted AC or RF voltages to some or all of the one or more electrodes in order to urge at least some ions along at least 5%, 10%, 15%, 20%, 25%, 30%, 35%, 40%, 45%, 50%, 55%, 60%, 65%, 70%, 75%, 80%, 85%, 90%, 95% or 100% of the axial length of the ion guide.

According to an embodiment the ion guide may comprise DC voltage means for maintaining a substantially constant DC voltage gradient along at least 5%, 10%, 15%, 20%, 25%, 30%, 35%, 40%, 45%, 50%, 55%, 60%, 65%, 70%, 75%, 80%, 85%, 90%, 95% or 100% of the axial length of the ion guide.

According to an embodiment at least some of the one or more electrodes may be provided, deposited or mounted in or on a printed circuit board. Preferably, at least some of the one or more electrodes are provided, deposited or mounted in or on a plastic, ceramic, laminate, insulating or semi-conducting substrate. The one or more electrodes may comprise: (i) a printed circuit board, printed wiring board or etched wiring board; (ii) a plurality of conductive traces applied or laminated onto a non-conductive substrate; (iii) a plurality of copper or metallic electrodes arranged on a substrate; (iv) a screen printed, photoengraved, etched or milled printed circuit board; (v) a plurality of electrodes arranged on a paper substrate impregnated with phenolic resin; (vi) a plurality of electrodes arranged on a fibreglass mat impregnated within an epoxy resin; (vii) a plurality of electrodes arranged on a plastic substrate; or (viii) a plurality of electrodes arranged on a substrate.

The ion guide preferably further comprises one or more apertures provided or arranged in a portion of the wall, wherein in a mode of operation ions are arranged to exit the ion guide via the one or more apertures.

The one or more apertures may have an internal diameter or dimension selected from the group consisting of: (i) ≤1.0 mm; (ii) ≤2.0 mm; (iii) ≤3.0 mm; (iv) ≤4.0 mm; (v) ≤5.0 mm; (vi) ≤6.0 mm; (vii) ≤7.0 mm; (viii) ≤8.0 mm; (ix) ≤9.0 mm; (x) ≤10.0 mm; and (xi) >10.0 mm.

Preferably, at least some ions or at least 0.1%, 0.5%, 1%, 2%, 3%, 4%, 5%, 10%, 15%, 20%, 25%, 30%, 35%, 40%, 45%, 50%, 55%, 60%, 65%, 70%, 75%, 80%, 85%, 90%, 95% or 100% of ions present within the hollow, tubular or mesh device are arranged to exit or are extracted from within the hollow, tubular or mesh device via the one or more apertures.

According to an embodiment at least some gas molecules and/or neutral particles and/or droplets or at least 0.1%, 0.5%, 1%, 2%, 3%, 4%, 5%, 10%, 15%, 20%, 25%, 30%, 35%, 40%, 45%, 50%, 55%, 60%, 65%, 70%, 75%, 80%, 85%, 90%, 95% or 100% of the gas molecules and/or neutral particles and/or droplets present within the hollow, tubular or mesh device are arranged to continue along the hollow, tubular or mesh device without exiting or being extracted from within the hollow, tubular or mesh device via the one or more apertures.

According to an embodiment an extraction lens or electrode arrangement is preferably arranged adjacent or behind the one or more apertures. The extraction lens or electrode arrangement is preferably arranged and adapted to draw or attract at least some ions through one or more apertures provided or arranged in a portion of the wall.

The ion guide preferably further comprises means arranged and adapted to maintain a potential or voltage difference between the one or more electrodes and the extraction lens or electrode arrangement. The means is preferably arranged and adapted to maintain a potential or voltage difference between the one or more electrodes and/or at least a portion of the wall of the hollow, tubular or mesh device and the extraction lens or electrode arrangement selected from the group consisting of: (i) <−50 V; (ii) −50 to −45 V; (iii) −45 to −40 V; (iv) −40 V to −35 V; (v) −35 V to −30 V; (vi) −30 to −25 V; (vii) −25V to −20 V; (viii) −20V to −15 V; (ix) −15 V to −10 V; (x) −10 V to −5 V; (xi) −5 V to 0 V; and (xii) >0 V. Such a potential or voltage difference is preferably applicable for positive ions. For negative ions, the means is preferably arranged and adapted to maintain a potential or voltage difference between the one or more electrodes and/or the wall of the hollow, tubular or mesh device and the extraction lens or electrode arrangement selected from the group consisting of: (i) >50 V; (ii) 50 to 45 V; (iii) 45 to 40 V; (iv) 40 V to 35 V; (v) 35V to 30 V; (vi) 30 to 25 V; (vii) 25V to 20 V; (viii) 20V to 15 V; (ix) 15 V to 10V; (x) 10 V to 5 V; (xi) 5 V to 0 V; and (xii) <0 V.

The ion guide preferably has a length selected from the group consisting of: (i) <1 mm; (ii) 1-5 mm; (iii) 5-10 mm; (iv) 10-15 mm; (v) 15-20 mm; (vi) 20-25 mm; (vii) 25-30 mm; (viii) 30-35 mm; (ix) 35-40 mm; (xi) 45-50 mm; (xii) 50-60 mm; (xiii) 60-70 mm; (xiv) 70-80 mm; (xv) 80-90 mm; (xvi) 90-100 mm; (xvii) 100-110 mm; (xviii) 110-120 mm; (xix) 120-130 mm; (xx) 130-140 mm; (xxi) 140-150 mm; (xxii) 150-160 mm; (xxiii) 160-170 mm; (xxiv) 170-180 mm; (xxv) 180-190 mm; (xxvi) 190-200 mm; and (xxvii) >200 mm. The ion guide may comprise a substantially straight or linear ion guide. Alternatively, the ion guide may comprise a substantially curved or non-linear ion guide.

The ion guide preferably further comprises means arranged and adapted to maintain at least a portion of the ion guide at a pressure selected from the group consisting of: (i) >0.001 mbar; (ii) >0.01 mbar; (iii) >0.1 mbar; (iv) >1 mbar; (v) >10 mbar; (vi) >100 mbar; (vii) 0.001-100 mbar; (viii) 0.01-10 mbar; and (ix) 0.1-1 mbar. The ion guide may be maintained at a pressure <100 mbar, <10 mbar, <1 mbar, <0.1 mbar, <0.01 mbar or 0.001 mbar.

According to an aspect of the present invention there is provided a mass spectrometer comprising one or more ion guides as described above.

The mass spectrometer preferably further comprises a collision, fragmentation or reaction device. The collision, fragmentation or reaction device is preferably arranged to fragment ions by Collisional Induced Dissociation ("CID").

According to another embodiment the collision, fragmentation or reaction device may be selected from the group consisting of: (i) a Surface Induced Dissociation ("SID") fragmentation device; (ii) an Electron Transfer Dissociation fragmentation device; (iii) an Electron Capture Dissociation fragmentation device; (iv) an Electron Collision or Impact Dissociation fragmentation device; (v) a Photo Induced Dissociation ("PID") fragmentation device; (vi) a Laser Induced Dissociation fragmentation device; (vii) an infrared radiation induced dissociation device; (viii) an ultraviolet radiation induced dissociation device; (ix) a nozzle-skimmer interface fragmentation device; (x) an in-source fragmentation device; (xi) an ion-source Collision Induced Dissociation fragmentation device; (xii) a thermal or temperature source fragmentation device; (xiii) an electric field induced fragmentation device; (xiv) a magnetic field induced fragmentation device; (xv) an enzyme digestion or enzyme degradation fragmentation device; (xvi) an ion-ion reaction fragmentation device; (xvii) an ion-molecule reaction fragmentation device; (xviii) an ion-atom reaction fragmentation device; (xix) an ion-metastable ion reaction fragmentation device; (xx) an ion-metastable molecule reaction fragmentation device; (xxi) an ion-metastable atom reaction fragmentation device; (xxii) an ion-ion reaction device for reacting ions to form adduct or product ions; (xxiii) an ion-molecule reaction device for reacting ions to form adduct or product ions; (xxiv) an ion-atom reaction device for reacting ions to form adduct or product ions; (xxv) an ion-metastable ion reaction device for reacting ions to form adduct or product ions; (xxvi) an ion-metastable molecule reaction device for reacting ions to form adduct or product ions; and (xxvii) an ion-metastable atom reaction device for reacting ions to form adduct or product ions.

A reaction device should be understood as comprising a device wherein ions, atoms or molecules are rearranged or reacted so as to form a new species of ion, atom or molecule. An X-Y reaction fragmentation device should be understood as meaning a device wherein X and Y combine to form a product which then fragments. This is different to a fragmentation device per se wherein ions may be caused to fragment without first forming a product. An X-Y reaction device should be understood as meaning a device wherein X and Y combine to form a product and wherein the product does not necessarily then fragment.

The mass spectrometer preferably further comprises an ion mobility spectrometer or separator arranged upstream and/or downstream of the ion guide.

The ion mobility spectrometer or separator preferably further comprises a gas phase electrophoresis device.

According to an embodiment the ion mobility spectrometer or separator comprises:

(i) a drift tube;

(ii) a multipole rod set or a segmented multipole rod set;

(iii) an ion tunnel or ion funnel; or (iv) a stack or array of planar, plate or mesh electrodes.

The drift tube may comprise one or more electrodes and means for maintaining an axial DC voltage gradient or a substantially constant or linear axial DC voltage gradient along at least 5%, 10%, 15%, 20%, 25%, 30%, 35%, 40%, 45%, 50%, 55%, 60%, 65%, 70%, 75%, 80%, 85%, 90%, 95% or 100% of the axial length of the drift tube.

The multipole rod set may comprise a quadrupole rod set, a hexapole rod set, an octapole rod set or a rod set comprising more than eight rods.

The ion tunnel or ion funnel preferably comprises a plurality of electrodes or at least 2, 5, 10, 20, 30, 40, 50, 60, 70, 80, 90 or 100 electrodes having apertures through which ions are transmitted in use and wherein at least 5%, 10%, 15%, 20%, 25%, 30%, 35%, 40%, 45%, 50%, 55%, 60%, 65%, 70%, 75%, 80%, 85%, 90%, 95% or 100% of the electrodes have apertures which are of substantially the same size or area or which have apertures which become progressively larger and/or smaller in size or in area. Preferably, at least 5%, 10%, 15%, 20%, 25%, 30%, 35%, 40%, 45%, 50%, 55%, 60%, 65%, 70%, 75%, 80%, 85%, 90%, 95% or 100% of the electrodes have internal diameters or dimensions selected from the group consisting of: (i) ≤1.0 mm; (ii) ≤2.0 mm; (iii) ≤3.0 mm; (iv) ≤4.0 mm; (v) ≤5.0 mm; (vi) ≤6.0 mm; (vii) ≤7.0 mm; (viii) ≤8.0 mm; (ix) ≤9.0 mm; (x) ≤10.0 mm; and (xi) >10.0 mm.

The stack or array of planar, plate or mesh electrodes preferably comprises a plurality or at least 2, 3, 4, 5, 6, 7, 8, 9, 10, 11, 12, 13, 14, 15, 16, 17, 18, 19 or 20 planar, plate or mesh electrodes arranged generally in the plane in which ions travel in use. Preferably, at least some or at least 5%, 10%, 15%, 20%, 25%, 30%, 35%, 40%, 45%, 50%, 55%, 60%, 65%, 70%, 75%, 80%, 85%, 90%, 95% or 100% of the planar, plate or mesh electrodes are supplied with an AC or RF voltage and wherein adjacent planar, plate or mesh electrodes are supplied with opposite phases of the AC or RF voltage.

According to an embodiment the ion mobility spectrometer or separator comprises a plurality of axial segments or at least 5, 10, 15, 20, 25, 30, 35, 40, 45, 50, 55, 60, 65, 70, 75, 80, 85, 90, 95 or 100 axial segments.

The mass spectrometer preferably further comprises DC voltage means for maintaining a substantially constant DC voltage gradient along at least a portion or at least 5%, 10%, 15%, 20%, 25%, 30%, 35%, 40%, 45%, 50%, 55%, 60%, 65%, 70%, 75%, 80%, 85%, 90%, 95% or 100% of the axial length of the ion mobility spectrometer or separator in order to urge at least some ions along at least a portion or at least 5%, 10%, 15%, 20%, 25%, 30%, 35%, 40%, 45%, 50%, 55%, 60%, 65%, 70%, 75%, 80%, 85%, 90%, 95% or 100% of the axial length of the ion mobility spectrometer or separator.

According to an embodiment the mass spectrometer further comprises transient DC voltage means arranged and adapted to apply one or more transient DC voltages or potentials or one or more transient DC voltage or potential waveforms to electrodes forming the ion mobility spectrometer or separator in order to urge at least some ions along at least 5%, 10%, 15%, 20%, 25%, 30%, 35%, 40%, 45%, 50%, 55%, 60%, 65%, 70%, 75%, 80%, 85%, 90%, 95% or 100% of the axial length of the ion mobility spectrometer or separator.

According to another embodiment the mass spectrometer preferably further comprises AC or RF voltage means arranged and adapted to apply two or more phase-shifted AC or RF voltages to electrodes forming the ion mobility spectrometer or separator in order to urge at least some ions along at least 5%, 10%, 15%, 20%, 25%, 30%, 35%, 40%, 45%, 50%, 55%, 60%, 65%, 70%, 75%, 80%, 85%, 90%, 95% or 100% of the axial length of the ion mobility spectrometer or separator.

The ion mobility spectrometer or separator preferably has an axial length selected from the group consisting of: (i) <20 mm; (ii) 20-40 mm; (iii) 40-60 mm; (iv) 60-80 mm; (v) 80-100 mm; (vi) 100-120 mm; (vii) 120-140 mm; (viii) 140-160 mm; (ix) 160-180 mm; (x) 180-200 mm; (xi) 200-220 mm; (xii) 220-240 mm; (xiii) 240-260 mm; (xiv) 260-280 mm; (xv) 280-300 mm; and (xvi) >300 mm.

The ion mobility spectrometer or separator preferably further comprises AC or RF voltage means arranged and adapted to apply an AC or RF voltage to at least 5%, 10%, 15%, 20%, 25%, 30%, 35%, 40%, 45%, 50%, 55%, 60%, 65%, 70%, 75%, 80%, 85%, 90%, 95% or 100% of the plurality of electrodes of the ion mobility spectrometer or separator in order to confine ions radially within the ion mobility spectrometer or separator.

The AC or RF voltage means is preferably arranged and adapted to supply an AC or RF voltage to the plurality of electrodes of the ion mobility spectrometer or separator having an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak.

The AC or RF voltage means is preferably arranged and adapted to supply an AC or RF voltage to the plurality of electrodes of the ion mobility spectrometer or separator having a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

According to an embodiment singly charged ions having a mass to charge ratio in the range of 1-100, 100-200, 200-300, 300-400, 400-500, 500-600, 600-700, 700-800, 800-900 or 900-1000 have a drift or transit time through the ion mobility spectrometer or separator in the range: (i) 0-1 ms; (ii) 1-2 ms; (iii) 2-3 ms; (iv) 3-4 ms; (v) 4-5 ms; (vi) 5-6 ms; (vii) 6-7 ms; (viii) 7-8 ms; (ix) 8-9 ms; (x) 9-10 ms; (xi) 10-11 ms; (xii) 11-12 ms; (xiii) 12-13 ms; (xiv) 13-14 ms; (xv) 14-15 ms; (xvi) 15-16 ms; (xvii) 16-17 ms; (xviii) 17-18 ms; (xix) 18-19 ms; (xx) 19-20 ms; (xxi) 20-21 ms; (xxii) 21-22 ms; (xxiii) 22-23 ms; (xxiv) 23-24 ms; (xxv) 24-25 ms; (xxvi) 25-26 ms; (xxvii) 26-27 ms; (xxviii) 27-28 ms; (xxix) 28-29 ms; (xxx) 29-30 ms; (xxxi) 30-35 ms; (xxxii) 35-40 ms; (xxxiii) 40-45 ms; (xxxiv) 45-50 ms; (xxxv) 50-55 ms; (xxxvi) 55-60 ms; (xxxvii) 60-65 ms; (xxxviii) 65-70 ms; (xxxix) 70-75 ms; (xl) 75-80 ms; (xli) 80-85 ms; (xlii) 85-90 ms; (xliii) 90-95 ms; (xliv) 95-100 ms; and (xlv) >100 ms.

The mass spectrometer preferably further comprises means arranged and adapted to maintain at least a portion of the ion mobility spectrometer or separator at a pressure selected from the group consisting of: (i) >0.001 mbar; (ii) >0.01 mbar; (iii) >0.1 mbar; (iv) >1 mbar; (v) >10 mbar; (vi) >100 mbar; (vii) 0.001-100 mbar; (viii) 0.01-10 mbar; and (ix) 0.1-1 mbar.

The mass spectrometer preferably further comprises an ion source. The ion source is preferably selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; and (xviii) a Thermospray ion source.

The ion source preferably comprises a pulsed or continuous ion source.

The mass spectrometer preferably comprises a mass analyser. The mass analyser is preferably selected from the group consisting of: (i) a Fourier Transform ("FT") mass analyser; (ii) a Fourier Transform Ion Cyclotron Resonance ("FTICR") mass analyser; (iii) a Time of Flight ("TOF") mass analyser; (iv) an orthogonal acceleration Time of Flight ("oaTOF") mass analyser; (v) an axial acceleration Time of Flight mass analyser; (vi) a magnetic sector mass spectrometer; (vii) a Paul or 3D quadrupole mass analyser; (viii) a 2D or linear quadrupole mass analyser; (ix) a Penning trap mass analyser; (x) an ion trap mass analyser; (xi) a Fourier Transform orbitrap; (xii) an electrostatic Fourier Transform mass spectrometer; and (xiii) a quadrupole mass analyser.

The mass spectrometer preferably further comprises one or more mass or mass to charge ratio filters and/or analysers. The one or more mass or mass to charge ratio filters and/or analysers are preferably selected from the group consisting of: (i) a quadrupole mass filter or analyser; (ii) a Wien filter; (iii) a magnetic sector mass filter or analyser; (iv) a velocity filter; and (v) an ion gate.

According to another aspect of the present invention there is provided a method of guiding ions comprising:

providing a hollow, tubular or mesh device having a wall and one or more electrodes arranged in, along, on or substantially adjacent to a portion of the wall; and passing ions into the hollow, tubular or mesh device.

According to another aspect of the present invention there is provided a method of mass spectrometry comprising a method of guiding ions.

According to another aspect of the present invention there is provided a method of making an ion guide comprising:

providing a substrate;

arranging one or more electrodes in, along, on or substantially adjacent to a portion of the substrate;

forming one or more apertures in the substrate through which ions are transmitted in use; and forming the substrate into a hollow, tubular or mesh ion guide.

According to another aspect of the present invention there is provided an ion guide comprising:

a hollow, tubular or mesh device having a wall;

one or more electrodes arranged in, along, on or substantially adjacent to a portion of the wall;

one or more apertures provided or arranged in a portion of the wall, wherein in a mode of operation ions are arranged to exit the ion guide via the one or more apertures; and wherein at least some gas molecules and/or neutral particles and/or droplets or at least 0.1%, 0.5%, 1%, 2%, 3%, 4%, 5%, 10%, 15%, 20%, 25%, 30%, 35%, 40%, 45%, 50%, 55%, 60%, 65%, 70%, 75%, 80%, 85%, 90%, 95% or 100% of the gas molecules and/or neutral particles and/or droplets present within the hollow, tubular or mesh device are arranged to continue along the hollow, tubular or mesh device without exiting or being extracted from within the hollow, tubular or mesh device via the one or more apertures.

The preferred ion guide preferably comprises a tubular conductor which is preferably arranged to transport ions in the presence of a relatively high pressure gas. A section of the wall of the tubular conductor is preferably replaced by one or more electrodes. The one or more electrodes preferably extend parallel to and offset from the central axis of the tubular conductor and are preferably arranged in, along, on or substantially adjacent to the wall of the tubular conductor.

At some point along the length of the tubular conductor, the one or more one or more electrodes may preferably terminate at an aperture in the wall of the tubular conductor.

A DC potential or voltage difference is preferably maintained between the wall of the tubular conductor and the one or more electrodes. The DC potential or voltage difference preferably causes ions to migrate through a flow of gas and preferably to move in a generally orthogonal direction to the flow of gas towards the one or more electrodes. To prevent the ions from actually striking the one or more electrodes, an AC or RF voltage is preferably applied to the one or more electrodes. The AC or RF voltage which is preferably applied to the one or more electrodes preferably provides a repulsive force which preferably forms an effective potential barrier. As a result, ions are preferably focused and held radially in a potential well which is preferably arranged to be in proximity to the one or more electrodes. As ions flow along the tubular conductor in the presence of a background gas the ions then preferably reach an aperture in the side or the wall of the tubular conductor. The focussed and confined beam of ions may pass through the aperture entrained in a flow of gas by maintaining a pressure difference across the exit aperture. Additionally or alternatively, ions may be arranged to pass through the aperture by arranging for a supplemental DC electric field to be applied which preferably penetrates through the exit aperture and which preferably acts to accelerate ions out of the tubular conductor.

The preferred ion guide is particularly advantageous compared to other conventional ion guides in that it can both focus and confine ions from a diffuse source without requiring excessively high voltages to be applied to the electrodes comprising the ion guide. Furthermore, since ions can be extracted orthogonally to the general direction of the gas flow, the ion guide substantially does not suffer from the effects of gas streaming. The ion guide also reduces the amount of contaminant build-up and neutral droplet transmission to subsequent vacuum chambers of a mass spectrometer.

BRIEF DESCRIPTION OF THE DRAWINGS

Various embodiments of the present invention will now be described, by way of example only, and with reference to the accompanying drawings in which.

DETAILED DESCRIPTION OF THE PREFERRED EMBODIMENTS

Figure 1:
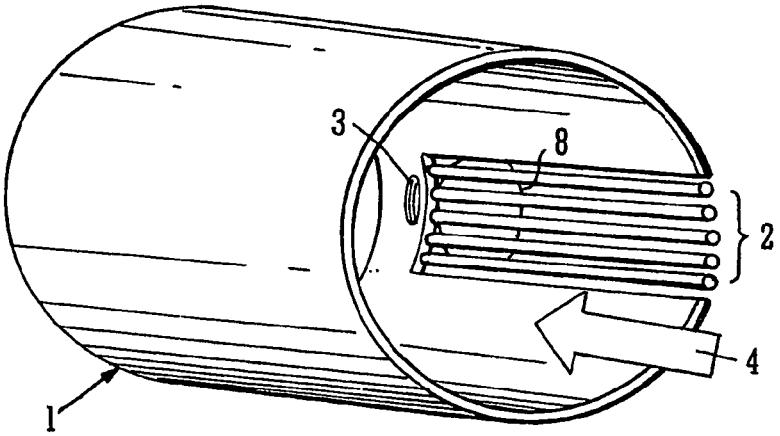
FIG. 1 shows an ion guide according to a preferred embodiment comprising a tubular conductor, a plurality of electrodes arranged in the wall of the tubular conductor and an exit aperture according downstream of the electrodes.

An ion guide according to an embodiment of the present invention will now be described with reference to FIG. 1. The ion guide preferably comprises a tubular conductor 1 or ion transport device. A plurality of electrodes 2 are preferably provided in a section of the wall of the tubular conductor 1 or ion transport device. An exit aperture 3 is preferably provided in the wall of the tubular conductor 1 downstream of the plurality of electrodes 2. The exit aperture 3 is preferably arranged adjacent to or in close proximity to the plurality of electrodes 2. According to the embodiment shown in FIG. 1 the plurality of electrodes 2 may comprise linear electrodes which terminate substantially adjacent the exit aperture 3. However, according to other embodiments at least some of the electrodes 2 may continue downstream past the exit aperture 3. At least some of the electrodes 2 may also loop around the exit aperture 3 as shown, for example, in the embodiment described with reference to FIG. 4A and FIG. 4B.

A mixture of ions and gas 4 preferably from an ion source (not shown) is preferably arranged to enter and flow through the tubular conductor 1 or ion transport device. In the absence of any electric field being maintained across or along the ion guide then the mixture of ions and gas 4 will preferably continue along and through the tubular conductor 1 or ion transport device with an ion radial density distribution which preferably remains essentially unchanged along the length of the ion guide. A small flow of gas and ions may be expected to pass through the exit aperture 3 particularly if an appropriate pressure gradient were to be maintained across the exit aperture 3.

As will be described in more detail below, according to the preferred embodiment an electric field is preferably maintained between the plurality of electrodes 2 and the wall of the tubular conductor 1. At least some of the plurality of electrodes 2 which are preferably provided in the wall of the tubular conductor 1 or which are preferably provided at least substantially adjacent to the wall of the tubular conductor 1 preferably lead ions to or towards the exit aperture 3. According to a preferred embodiment a positive or negative DC potential difference is preferably maintained between the wall of the tubular conductor 1 and at least some or substantially all of the plurality of electrodes 2 provided in the wall of the tubular conductor 1.

According to an embodiment the wall of the tubular conductor 1 may be maintained at a positive or negative DC potential and the plurality of electrodes 2 may be maintained at 0 V DC. Accordingly, an electric field is preferably generated which acts so as to focus positive or negative ions passing through the tubular conductor 1 towards the plurality of electrodes 2.

Figure 2:
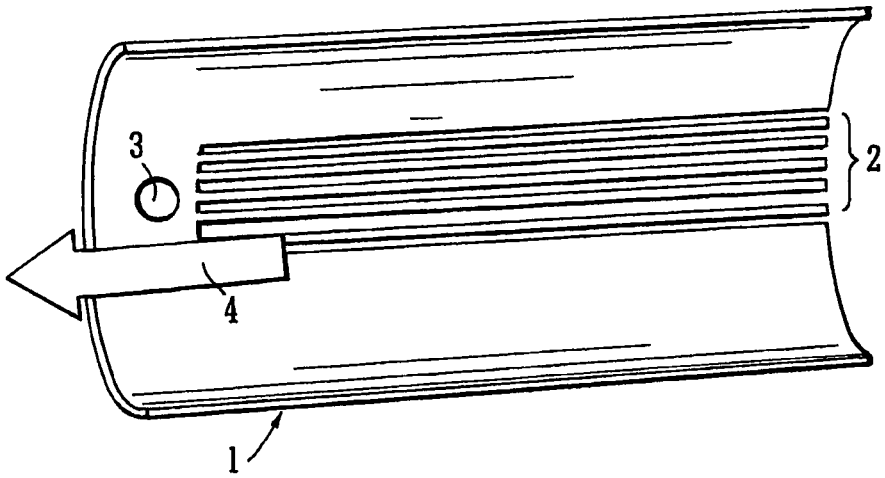
FIG. 2 shows inside a preferred ion guide and shows in more detail the plurality of electrodes arranged in the wall of the tubular conductor and the exit aperture.

FIG. 2 shows a view inside a portion of a preferred ion guide and shows more clearly the plurality of electrodes 2 leading up to an exit aperture 3 provided in the wall of the tubular conductor 1. The exit aperture 3 is shown arranged downstream of the plurality of electrodes 2, but according to other embodiments at least some of the plurality of electrodes 2 may continue beyond and further downstream of the exit aperture 3.

Figure 3:
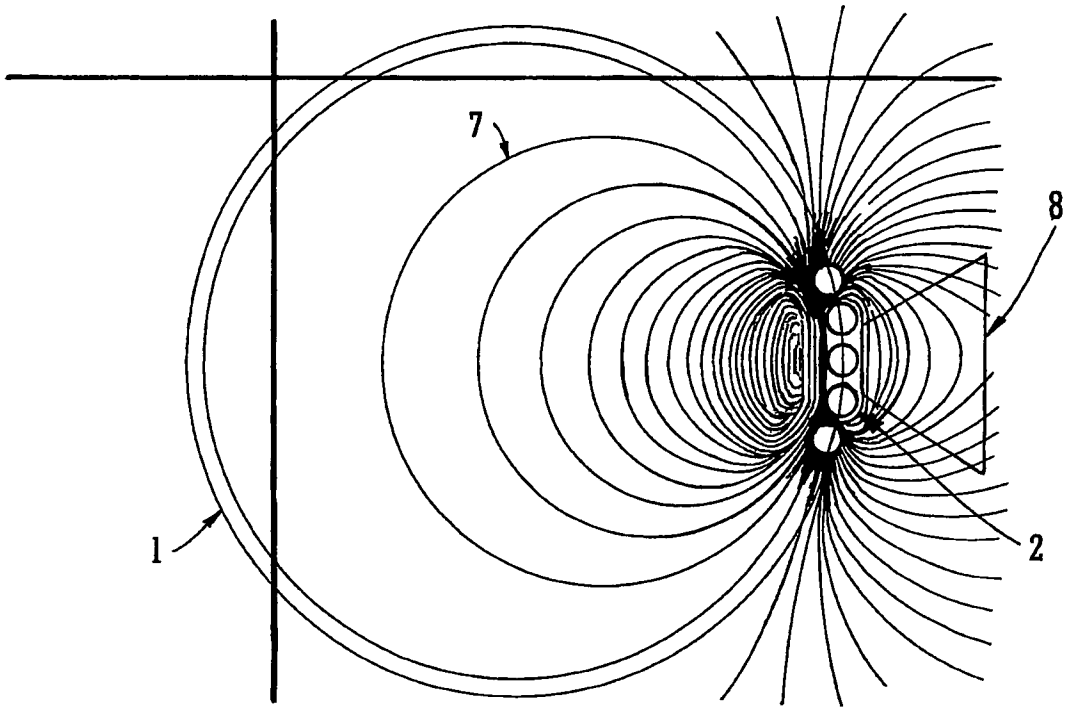
FIG. 3 shows a cross-sectional view of a preferred ion guide and shows the electric potential contours resulting from maintaining a DC potential or voltage difference between the wall of tubular conductor and the plurality of electrodes arranged in the wall of the tubular conductor.

FIG. 3 shows DC electric potential contours 7 which result from maintaining a DC potential or voltage difference between the wall of the tubular conductor 1 and the plurality of electrodes 2. An extraction lens or electrode 8 is also shown external to the tubular conductor 1. The extraction lens or electrode 8 is preferably arranged adjacent the exit aperture 3. A supplemental DC potential or voltage is preferably applied to the extraction lens or electrode 8 in order to generate an electric field which preferably assists in extracting or orthogonally accelerating ions out from within the tubular conductor 1 through the exit aperture 3 to the outside of the tubular conductor 1.

According to a less preferred embodiment a DC potential or voltage difference may be maintained between the wall of the tubular conductor 1 and the plurality of electrodes 2 provided in the wall of the tubular conductor 1. As a result ions are preferably drawn towards the electrodes 2 and at least some of the ions may strike or hit the electrodes 2 and will become lost to the system.

According to a much more preferred embodiment an AC or RF voltage is also additionally applied to the plurality of electrodes 2. The AC or RF voltage which is preferably applied to the plurality of electrodes 2 preferably generates a repulsive effective or pseudo-potential which preferably acts to prevent ions from striking the plurality of electrodes 2.

According to the preferred embodiment ions passing through the ion guide are preferably subjected to two opposing forces. Ions are preferably drawn towards the plurality of electrodes 2 due to the electric field resulting from maintaining a DC potential difference between the wall of the tubular conductor 1 and the plurality of electrodes 2 whilst at the same time ions are also preferably repelled away from the plurality of electrodes 2 by the pseudo-potential field which results from the application of an AC or RF voltage to the plurality of electrodes 2. It will be appreciated that the net effect of the two opposing forces is that ions are preferably confined in the radial direction within the tubular conductor 1.

If a plurality of electrodes 2 are provided in the wall of the tubular conductor 1 then according to the preferred embodiment opposite phases of a two-phase AC or RF voltage are preferably applied to adjacent electrodes 2.

According to the preferred embodiment ions are preferably caused to travel in an axial direction along the length of the tubular conductor 1 together with any gas molecules and neutral particles present in the flow admitted into the ion guide. According to the preferred embodiment ions preferably become at least partially separated from gas molecules and neutral particles flowing through the ion guide. Furthermore, according to the preferred embodiment ions present in the ion guide are preferably concentrated and/or focused along an axis which is preferably in relatively close proximity to the plurality of electrodes 2. The ions are then preferably transported or delivered to the exit aperture 3 in or as a substantially concentrated beam. A concentrated beam of ions is then preferably arranged to exit the tubular conductor 1 through the exit aperture 3.

Ions entrained in flow of gas may be arranged to pass through the exit aperture 3 due to a pressure gradient being maintained between the inside of the tubular conductor 1 and the outside of the tubular conductor 1. According to an embodiment ions may be assisted in being extracted or ejected through the exit aperture 3 by a further electric field which is preferably maintained so as to orthogonally accelerate ions through the exit aperture 3.

The further electric field may be generated by applying a DC potential to an extraction lens or electrodes 8 which is preferably located adjacent and/or behind the exit aperture 3. The extraction lens or electrodes 8 is preferably positioned or located external to the tubular conductor 1.

Figure 4A:
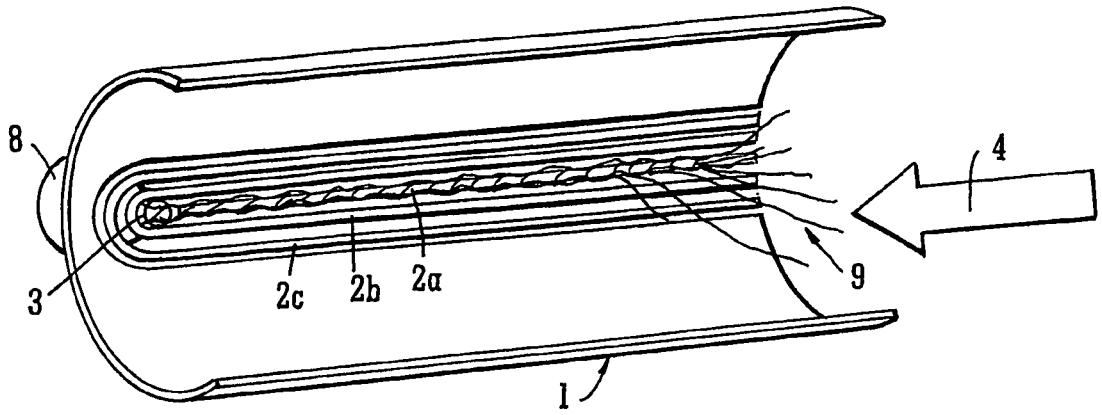
FIG. 4A shows the results of a simulation of ions entering a preferred ion guide comprising a tubular conductor wherein the ions are focussed close to the plurality of electrodes which run along the wall of the tubular conductor and wherein the ions emerge from the ion guide via an exit aperture and FIG. 4B shows in greater detail two electrodes provided in the wall of the tubular conductor which loop around the exit aperture and a third linear electrode which terminates at the exit aperture.
Figure 4B:
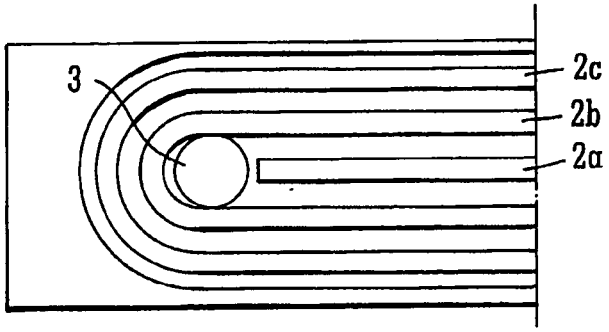

According to another embodiment at least some of the electrodes 2 provided in the wall of the tubular conductor 1 may be arranged so as to loop around the exit aperture 3. FIG. 4A shows an embodiment wherein two electrodes 2*b*,2*c* loop around an exit aperture 3 and another linear electrode 2*a* terminates in close proximity to the exit aperture 3.

The trajectories of different ions as they enter an ion guide as shown in FIG. 4A were modelled using the SIMION® v7.0 ion optics package. A user program was written to incorporate the effects of collisions between ions and a background gas. The ions become focussed in close proximity to the electrodes 2*a*,2*b*,2*c* as they pass through the ion guide. The inside diameter of the tubular conductor 1 was modelled as being 6.0 mm and the overall length of the tubular conductor 1 was modelled as being 15.0 mm. The ion guide was arranged to comprise three electrodes 2*a*,2*b*, 2*c*. The three electrodes 2*a*,2*b*,2*c* had a substantially circular cross-section and had a diameter of 0.2 mm. The three electrodes 2*a*,2*b*,2*c* were spaced 0.4 mm centre-to-centre.

An exit aperture 3 was modelled as being provided in the wall of the tubular conductor 1. The exit aperture 3 was modelled as being 1.4 mm in diameter. The centre of the exit aperture 3 was set so as to be 13.5 mm from the entrance of the tubular conductor 1. An extraction lens or electrode 8 was modelled as being provided external to the tubular conductor 1. The centre of the extraction lens 8 was modelled as being 13.5 mm from the entrance of the tubular conductor 1.

The simulation was carried out by modelling the wall of the tubular conductor 1 as being maintained at 20 V DC and the three electrodes 2*a*,2*b*,2*c* as being maintained at 0 V DC. The extraction lens or electrode 8 was modelled as being maintained at −10 V. An AC or RE voltage having a frequency of 2 MHz and 200 V peak-peak was modelled as being applied to the plurality of electrodes 2*a*,2*b*,2*c* with opposite phases of the AC or RF voltage being applied to adjacent electrodes 2*a*,2*b*,2*c*. The background gas pressure was modelled as being 2 mbar with an imposed flow velocity of 50 m/s. The ions were modelled as having a mass to charge ratio of 500 and the background gas was simulated as being Argon. The trajectories 9 of a plurality of ions are shown in FIG. 4A. The ions are shown starting from different regions across the diameter of the tubular conductor 1. The ion trajectories 9 which resulted indicate that ions are effectively focussed and confined prior to being orthogonally extracted through the exit aperture 3 by means of the extraction lens or electrode 8.

Two of the electrodes 2*b*,2*c* are arranged so that they loop around the exit aperture 3 and hence also the entrance to the extraction lens or electrode 8. A third innermost linear electrode 2*a* terminates opposite or adjacent to the exit aperture 3.

Figure 5:
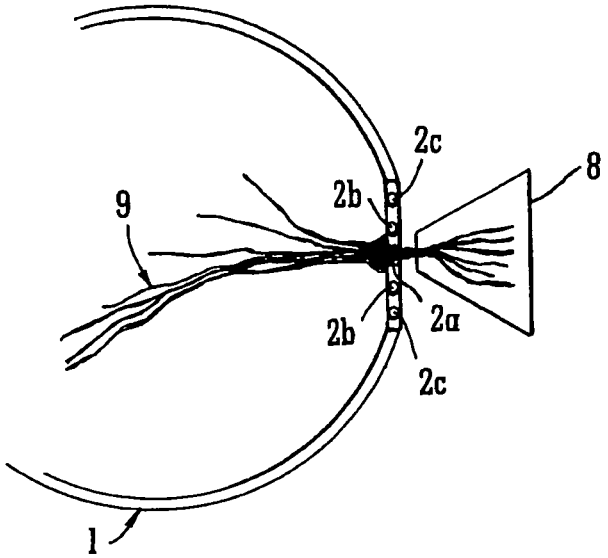
FIG. 5 shows a cross-sectional view showing the various trajectories of ions as they pass through the ion guide shown in FIG. 4 according to the model and as the ions emerge from the exit aperture provided in the wall of the tubular conductor.

Various ion starting points were used across the diameter of the tubular conductor 1. As can be seen from the ion trajectories 9 shown in FIG. 4A and FIG. 5, the combined effect of the AC or RF voltage applied to the electrodes 2*a*,2*b*,2*c* and the DC potential difference maintained between the wall of the tubular conductor 1 and the electrodes 2*a*,2*b*,2*c* provided effective focussing and confinement of the ions in the radial direction. The ions were also confined sufficiently close to the electrodes 2*a*,2*b*,2*c* such that it was then possible to extract the ions from the main gas flow using the extraction lens or electrodes 8.

An ion guide according to the preferred embodiment is particularly advantageous compared to other known ion guides in regions of operation wherein the gas pressure is relatively high (i.e. $>10^{-2}$ mbar) and/or the cross sectional area of the gas flow is high and may contain larger droplets. The preferred ion guide may therefore advantageously be used in the first vacuum stage of a mass spectrometer operating with an ion source at atmospheric pressure (e.g. an Electrospray, Atmospheric Pressure Chemical Ionisation, Atmospheric Pressure MALDI, or an Atmospheric Pressure Photoionization ion source). The preferred ion guide may also be used to focus and extract ions from a gas for subsequent transport of the ions through a differential pumping aperture into a further vacuum chamber of a mass spectrometer.

The preferred ion guide may be operated over gas pressures ranging from $10^{-3}$ mbar to 100 mbar, preferably in the range from $10^{-2}$ mbar to 10 mbar.

Whilst the preferred ion guide preferably comprises a tubular conductor 1 having a substantially circular cross-section or cross-sectional profile, the ion guide may comprise conductors having other different cross sections or cross-sectional profiles.

The number of electrodes 2*a*,2*b*,2*c* provided in the wall of the tubular conductor 1 may vary from one to ten. According to another embodiment more than ten electrodes may be provided in the wall of the tubular conductor 1.

The electrodes are preferably spaced out on a section of the circumference of the tubular conductor 1 and preferably extend in a direction that is preferably parallel to the central axis of the tubular conductor 1.

Figure 6:
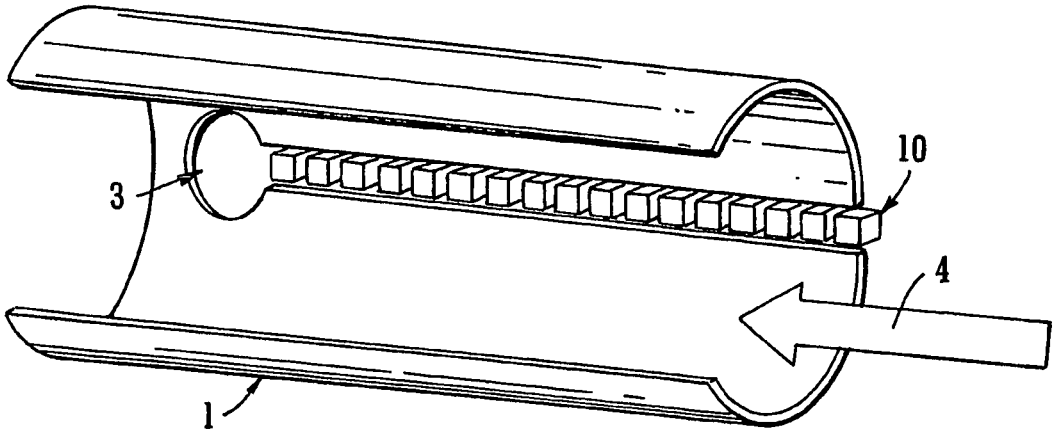
FIG. 6 shows an embodiment of the present invention wherein a plurality of axially segmented electrodes are provided in the wall of a tubular conductor ion guide.

A further embodiment of the present invention is shown in FIG. 6. According to this embodiment a plurality of electrodes 10 are provided in the wall of the tubular conductor 1. The electrodes preferably have a substantially square cross-section and are preferably cubic in shape. The electrodes 10 are preferably spaced or separated in or along the axial direction of the ion guide.

Figure 7:
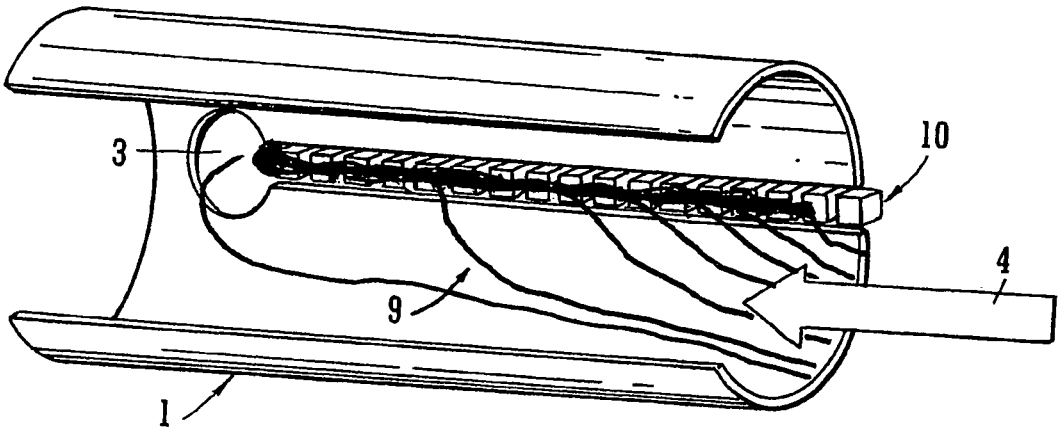
FIG. 7 shows a simulation of ions entering the ion guide shown in FIG. 6 wherein the ions are focussed close to the plurality of axially segmented electrodes provided in the wall of the tubular conductor.
Figure 8:
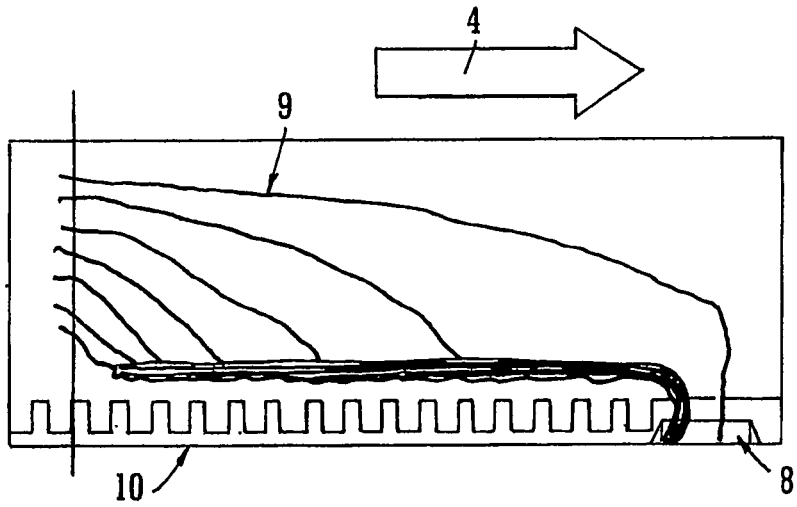
FIG. 8 shows a plan view of the trajectories of the ions as modelled and shown in FIG. 7.

According to a preferred embodiment opposite phases of an AC or RF voltage are preferably applied to adjacent electrodes 10. The trajectories 9 of different ions through the ion guide are shown in FIGS. 7 and 8 and were modelled using SIMION®. The inside diameter of the tubular conductor 1 was modelled as being 6.0 mm and the overall length of the tubular conductor 1 was modelled as being 15.0 mm. The electrodes 10 were modelled as comprising 0.5 mm cubic electrodes separated with a 0.75 mm centre-to-centre spacing. The diameter of the exit aperture 3 was 2.0 mm. The centre of the exit aperture was modelled as being spaced 13.5 mm from the entrance of the tubular conductor 1.

The tubular conductor 1 was modelled as being maintained at 10 V and the electrodes 10 were modelled as being maintained at 0 V DC. An AC or RF voltage having a frequency of 2 MHz and 200 V peak-peak was modelled as being applied to the electrodes 10 with opposite phases of the AC or RF voltage being applied to adjacent electrodes 10. The background gas pressure was modelled as being 2 mbar with an imposed flow velocity of 50 m/s. The ions were modelled as having a mass to charge ratio of 500 and the background gas was simulated as being Argon.

FIG. 7 shows the various trajectories 9 of the ions as they pass through the ion guide. As can be seen from FIG. 7 the ion guide is particularly efficient at focusing and transporting ions for subsequent orthogonal extraction despite ions having ion trajectories starting at various points across the diameter or the tubular conductor 1.

FIG. 8 shows in more detail the various ion trajectories 9 viewed as a plan projection.

For ease of construction the electrodes 2,10 provided in the wall of the tubular conductor 1 may be mounted on a printed circuit board to provide all necessary voltage connections or may comprise tracks arranged on the printed circuit board. For applications where relatively high temperature operation is required the one or more electrodes 2,10 may be mounted in or on a thermally stable plastic or a ceramic substrate. Alternatively, the electrodes 2,10 may be mounted on a ceramic using thick film technology.

Although the present invention has been described with reference to preferred embodiments, it will be understood by those skilled in the art that various changes in form and detail may be made without departing from the scope of the invention as set forth in the accompanying claims.

The invention claimed is:

1. An ion guide comprising:

a hollow, tubular or mesh electrically conducting device having a wall;

one or more electrodes arranged in, along, on or substantially adjacent to a portion of said wall;

one or more apertures provided or arranged in a portion of said wall, wherein in a mode of operation ions are arranged to exit said ion guide via said one or more apertures; and means arranged and adapted to maintain a DC potential difference between at least a portion of said wall and some or all of said one or more electrodes.

2. An ion guide as claimed in claim 1, wherein said hollow, tubular or mesh electrically conducting device has a central axis disposed in or along the centre or middle of said hollow, tubular or mesh electrically conducting device and wherein said one or more electrodes are arranged or disposed offset from or to one side of said central axis.

3. An ion guide as claimed in claim 2, wherein said one or more electrodes are arranged along one or more axes which are substantially parallel to said central axis.

4. An ion guide as claimed in claim 1, further comprising AC or RF voltage means arranged and adapted to apply an AC or RF voltage to at least some or all of said one or more electrodes.

5. An ion guide as claimed in claim 4, wherein said AC or RF voltage means is arranged and adapted to apply an AC or RF voltage to at least 5%, 10%, 20%, 30%, 40%, 50%, 60%, 70%, 80%, 90%, 95% or 100% of said one or more electrodes in order to repel or substantially prevent at least some ions from striking, colliding with or approaching said one or more electrodes.

6. An ion guide as claimed in claim 4, wherein immediately adjacent electrodes of said one or more electrodes are supplied with opposite phases of said AC or RF voltage.

7. An ion guide as claimed in claim 1, wherein said DC potential difference is selected from the group consisting of: (i) <1 V; (ii) 1-5 V; (iii) 5-10 V; (iv) 10-15 V; (v) 15-20 V; (vi) 20-25 V; (vii) 25-30 V; (viii) 30-35 V; (ix) 35-40 V; (x) 40-45 V; (xi) 45-50 V; and (xii) >50 V.

8. Anion guide as claimed in claim 1, wherein at least 1, 2, 3, 4, 5, 6, 7, 8, 9, 10, 11, 12, 13, 14, 15, 16, 17, 18, 19, 20 or >20 of said one or more electrodes are arranged to loop around or at least partially loop around said one or more apertures provided in said hollow, tubular or mesh electrically conducting device.

9. An ion guide as claimed in claim 1, wherein at least 1, 2, 3, 4, 5, 6, 7, 8, 9, 10, 11, 12, 13, 14, 15, 16, 17, 18, 19, 20 or >20 of said electrodes are arranged to terminate at or upstream of said one or more apertures provided in said hollow, tubular or mesh electrically conducting device.

10. An ion guide as claimed in claim 1, further comprising means for applying one or more transient DC voltages or potentials or one or more transient DC voltage or potential waveforms to some or all of said one or more electrodes in order to urge at least some ions along at least 5%, 10%, 15%, 20%, 25%, 30%, 35%, 40%, 45%, 50%, 55%, 60%, 65%, 70%, 75%, 80%, 85%, 90%, 95% or 100% of the axial length of said ion guide.

11. An ion guide as claimed in claim 1, further comprising means for applying two or more phase-shifted AC or RF voltages to some or all of said one or more electrodes in order to urge at least some ions along at least 5%, 10%, 15%, 20%, 25%, 30%, 35%, 40%, 45%, 50%, 55%, 60%, 65%, 70%, 75%, 80%, 85%, 90%, 95% or 100% of the axial length of said ion guide.

12. An ion guide as claimed in claim 1, further comprising DC voltage means for maintaining a substantially constant DC voltage gradient along at least 5%, 10%, 15%, 20%, 25%, 30%, 35%, 40%, 45%, 50%, 55%, 60%, 65%, 70%, 75%, 80%, 85%, 90%, 95% or 100% of the axial length of said ion guide.

13. An ion guide as claimed in claim 1, wherein at least some of said one or more electrodes are provided, deposited or mounted in or on a printed circuit board.

14. An ion guide as claimed in claim 1, wherein at least some of said one or more electrodes are provided, deposited or mounted in or on a plastic, ceramic, laminate, insulating or semi-conducting substrate.

15. An ion guide as claimed in claim 1, wherein, in use, at least some ions or at least 0.1%, 0.5%, 1%, 2%, 3%, 4%, 5%, 10%, 15%, 20%, 25%, 30%, 35%, 40%, 45%, 50%, 55%, 60%, 65%, 70%, 75%, 80%, 85%, 90%, 95% or 100% of ions present within said hollow, tubular or mesh electrically conducting device are arranged to exit or are extracted from within said hollow, tubular or mesh electrically conducting device via said one or more apertures.

16. An ion guide as claimed in claim 1, wherein, in use, at least some gas molecules or neutral particles or droplets or at least 0.1%, 0.5%, 1%, 2%, 3%, 4%, 5%, 10%, 15%, 20%, 25%, 30%, 35%, 40%, 45%, 50%, 55%, 60%, 65%, 70%, 75%, 80%, 85%, 90%, 95% or 100% of the gas molecules or neutral particles or droplets present within said hollow, tubular or mesh electrically conducting device are arranged to continue along said hollow, tubular or mesh electrically conducting device without exiting or being extracted from within said hollow, tubular or mesh electrically conducting device via said one or more apertures.

17. An ion guide as claimed in claim 1, further comprising:

an extraction lens or electrode arrangement arranged adjacent or behind said one or more apertures; and means arranged and adapted to maintain a potential or voltage difference between said one or more electrodes or the wall of said hollow, tubular or mesh electrically conducting device and said extraction lens or electrode arrangement.

18. An ion guide as claimed in claim 1, further comprising means arranged and adapted to maintain at least a portion of said ion guide at a pressure selected from the group consisting of: (i) >0.001 mbar; (ii) >0.01 mbar; (iii) >0.1 mbar; (iv) >1 mbar; (v) >10 mbar; (vi) >100 mbar; (vii) 0.001-100 mbar; (viii) 0.01-10 mbar; and (ix) 0.1-1 mbar.

19. A mass spectrometer comprising one or more ion guides as claimed in claim 1.

20. A mass spectrometer as claimed in claim 19, further comprising an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; and (xviii) a Thermospray ion source.

21. A method of guiding ions comprising:

providing a hollow, tubular or mesh electrically conducting device having a wall, one or more electrodes arranged in, along, on or substantially adjacent to a portion of said wall and one or more apertures arranged in a portion of said wall;

passing ions into and along said hollow, tubular or mesh electrically conducting device;

maintaining a DC potential difference between at least a portion of said wall and some or all of said one or more electrodes; and passing ions out of said hollow, tubular or mesh electrically conducting device through said one or more apertures.

22. A method of mass spectrometry comprising a method of guiding ions as claimed in claim 21.

23. A method of making an ion guide comprising:

providing a substrate;

arranging one or more electrodes in, along, on or substantially adjacent to a portion of said substrate;

providing means for maintaining, in use, a DC potential difference between a portion of said substrate and said one or more electrodes;

forming one or more apertures in said substrate through which ions are transmitted in use; and forming said substrate into a hollow, tubular or mesh electrically conducting ion guide.

24. An ion guide comprising:

a hollow, tubular or mesh electrically conducting device having a wall;

one or more electrodes arranged in, along, on or substantially adjacent to a portion of said wall;

one or more apertures provided or arranged in a portion of said wall, wherein in a mode of operation ions are arranged to exit said ion guide via said one or more apertures;

means arranged and adapted to maintain a DC potential difference between at least a portion of said wall and some or all of said one or more electrodes; and an AC or RF voltage source arranged and adapted to apply an AC or RF voltage to at least some of said one or more electrodes.

25. An ion guide as claimed in claim 24, wherein said hollow, tubular or mesh electrically conducting device has a central axis disposed in or along the centre or middle of said hollow, tubular or mesh electrically conducting device and wherein said one or more electrodes are arranged or disposed offset from or to one side of said central axis;

one or more electrodes are arranged along one or more axes which are substantially parallel to said central axis;

said AC or RF voltage source is arranged and adapted to apply an AC or RF voltage to at least 5% of said one or more electrodes in order to repel or substantially prevent at least some ions from striking, colliding with or approaching said one or more electrodes;

immediately adjacent electrodes of said one or more electrodes are supplied with opposite phases of said AC or RF voltage;

an extraction lens or electrode arrangement arranged adjacent or behind said one or more apertures; and means arranged and adapted to maintain a potential or voltage difference between said one or more electrodes or the wall of said hollow, tubular or mesh electrically conducting device and said extraction lens or electrode arrangement.

* * * * *